US010655870B2

(12) United States Patent
Lowenstein

(10) Patent No.: US 10,655,870 B2
(45) Date of Patent: May 19, 2020

(54) METHODS FOR ENHANCING THE DEHUMIDIFICATION OF HEAT PUMPS

(71) Applicant: AIL RESEARCH INC., Princeton Junction, NJ (US)

(72) Inventor: Andrew Lowenstein, Princeton Junction, NJ (US)

(73) Assignee: AIL RESEARCH, INC., Hopewell, NJ (US)

( * ) Notice: Subject to any disclaimer, the term of this patent is extended or adjusted under 35 U.S.C. 154(b) by 541 days.

(21) Appl. No.: 15/504,528

(22) PCT Filed: Oct. 24, 2014

(86) PCT No.: PCT/US2014/062262
§ 371 (c)(1),
(2) Date: Feb. 16, 2017

(87) PCT Pub. No.: WO2015/061739
PCT Pub. Date: Apr. 30, 2015

(65) Prior Publication Data

US 2017/0241654 A1 Aug. 24, 2017

Related U.S. Application Data

(60) Provisional application No. 61/895,809, filed on Oct. 25, 2013, provisional application No. 62/015,155, filed on Jun. 20, 2014.

(51) Int. Cl.
*F24F 3/14* (2006.01)

(52) U.S. Cl.
CPC ..... *F24F 3/1417* (2013.01); *F24F 3/1429* (2013.01); *F24F 2003/1458* (2013.01)

(58) Field of Classification Search
CPC ..... F24F 3/1417; F24F 3/1411; F24F 3/1429; F24F 3/147; F24F 2003/1458;
(Continued)

(56) References Cited

U.S. PATENT DOCUMENTS 4,180,985 A 1/1980 Northrup, Jr.
4,259,849 A 4/1981 Griffiths
(Continued)

FOREIGN PATENT DOCUMENTS

JP H1144439 A 2/1990
WO 2007082103 A2 7/2007

OTHER PUBLICATIONS

International Search Report of PCT/US2014/062262 dated Feb. 5, 2015.
(Continued)

*Primary Examiner* — Joseph F Trpisovsky
(74) *Attorney, Agent, or Firm* — Amster, Rothstein & Ebenstein LLP

(57) ABSTRACT

A device for cooling and dehumidifying a first stream of air includes a first heat exchanger that cools the first stream of air from a first temperature to a lower second temperature, an absorber, a regenerator and one or more pumps and conduits. The device operates under conditions where liquid desiccant removes moisture from the first stream of air in the absorber and the second temperature of the first stream of air that leaves the first heat exchanger is lower than the temperature of the liquid desiccant supplied to the absorber.

18 Claims, 11 Drawing Sheets

A Vapor-Compression Air Conditioner with Adiabatic Liquid-Desiccant Absorber and Desorber with Interchange Heat Exchanger (IHX)

(58) Field of Classification Search
CPC .. B01D 53/1425; B01D 53/18; B01D 53/185; B01D 53/263; F25B 17/02; F25B 35/02; F25B 37/00
USPC ..... 62/94
See application file for complete search history.

(56) References Cited

U.S. PATENT DOCUMENTS

| | | | | |
|---|---|---|---|---|
| 4,941,324 | A | 7/1990 | Peterson et al. | |
| 5,351,497 | A | 10/1994 | Lowenstein | |
| 6,216,483 | B1 | 4/2001 | Potnis et al. | |
| 7,306,650 | B2 * | 12/2007 | Slayzak ..... | B01D 47/14 95/231 |
| 8,171,746 | B2 | 5/2012 | Miyauchi | |
| 2004/0112077 | A1 * | 6/2004 | Forkosh ..... | F24F 3/1417 62/271 |
| 2013/0055756 | A1 * | 3/2013 | Tsutsumi ..... | B01D 53/1425 62/617 |

OTHER PUBLICATIONS

Written Opinion of the International Searching Authority of PCT/US2014/062262 dated Feb. 4, 2015.
Extended European Search Report dated Jun. 30, 2017.

* cited by examiner

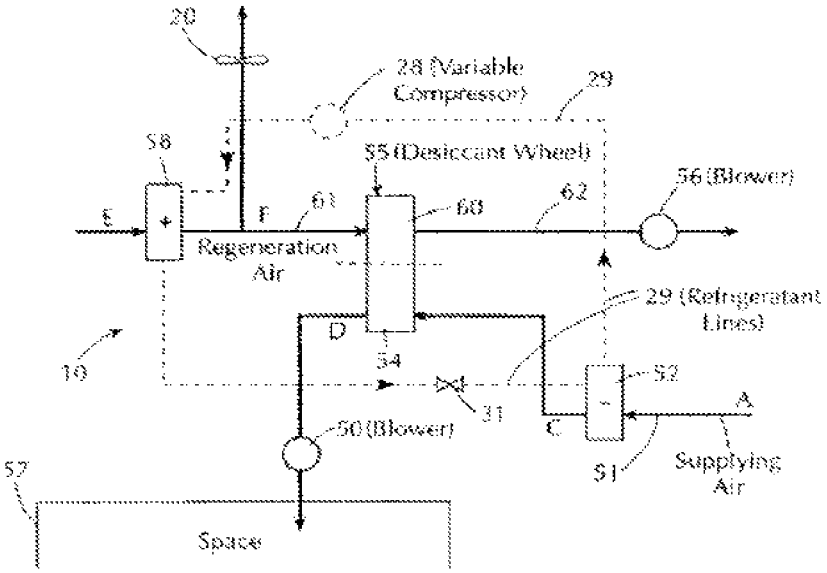
Figure 1 – A Solid-Desiccant Vapor-Compression Air Conditioner
CONVENTIONAL ART

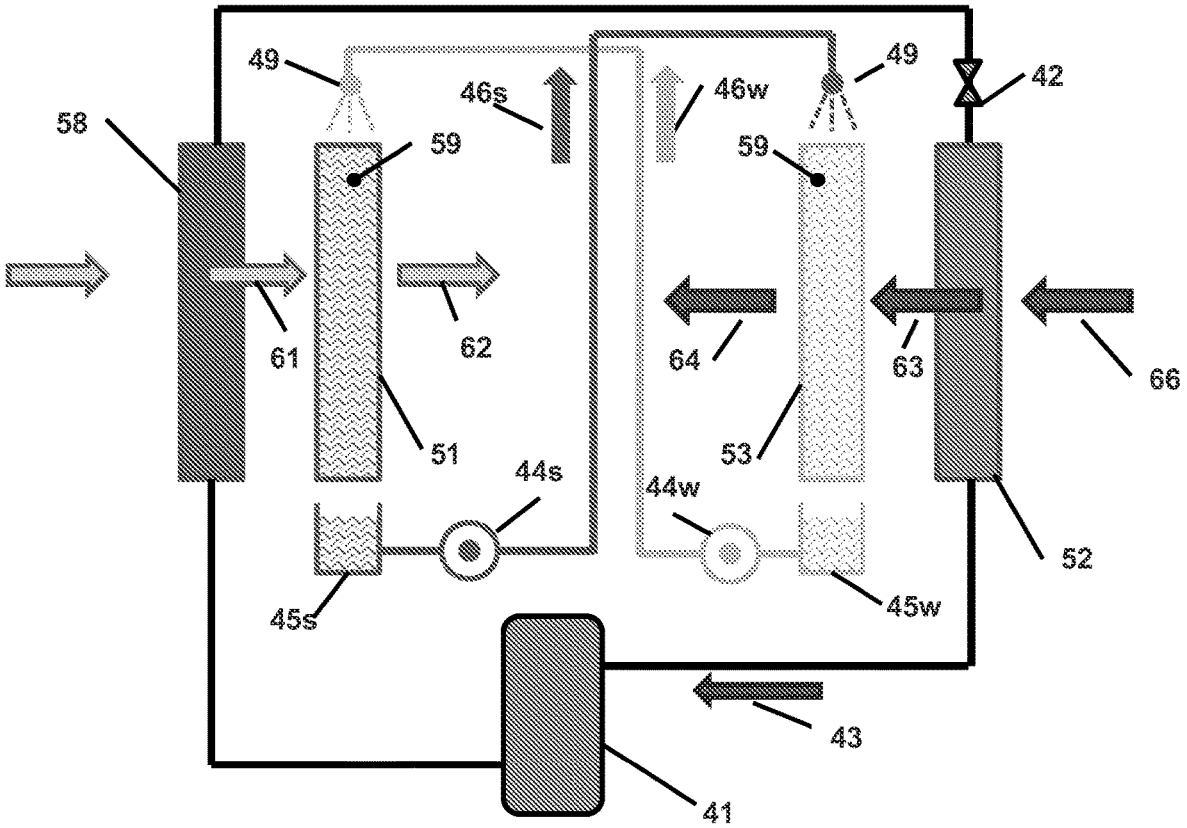
Figure 2 – A Vapor-Compression Air Conditioner with Adiabatic Liquid-Desiccant Absorber and Desorber

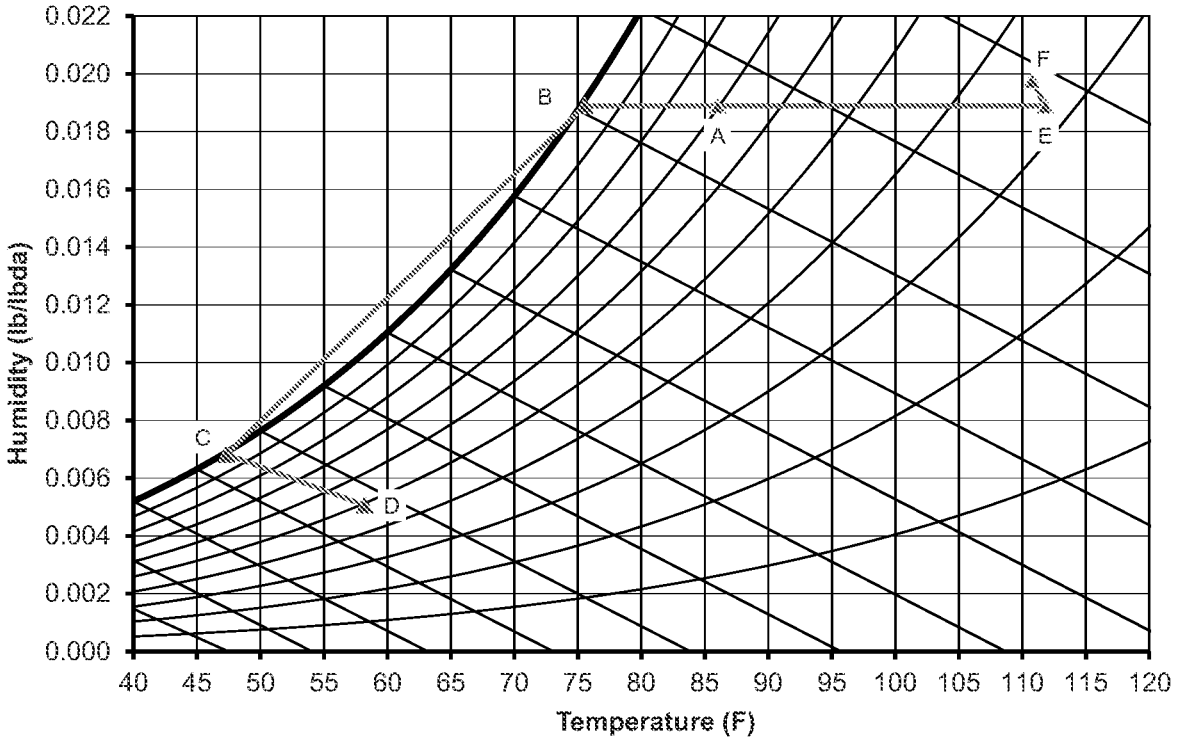
Figure 3 – A Psychrometric Chart Showing the Air State Points for a Heat Pump that uses a Liquid Desiccant Absorber and Desorber to Enhance Its Latent Cooling

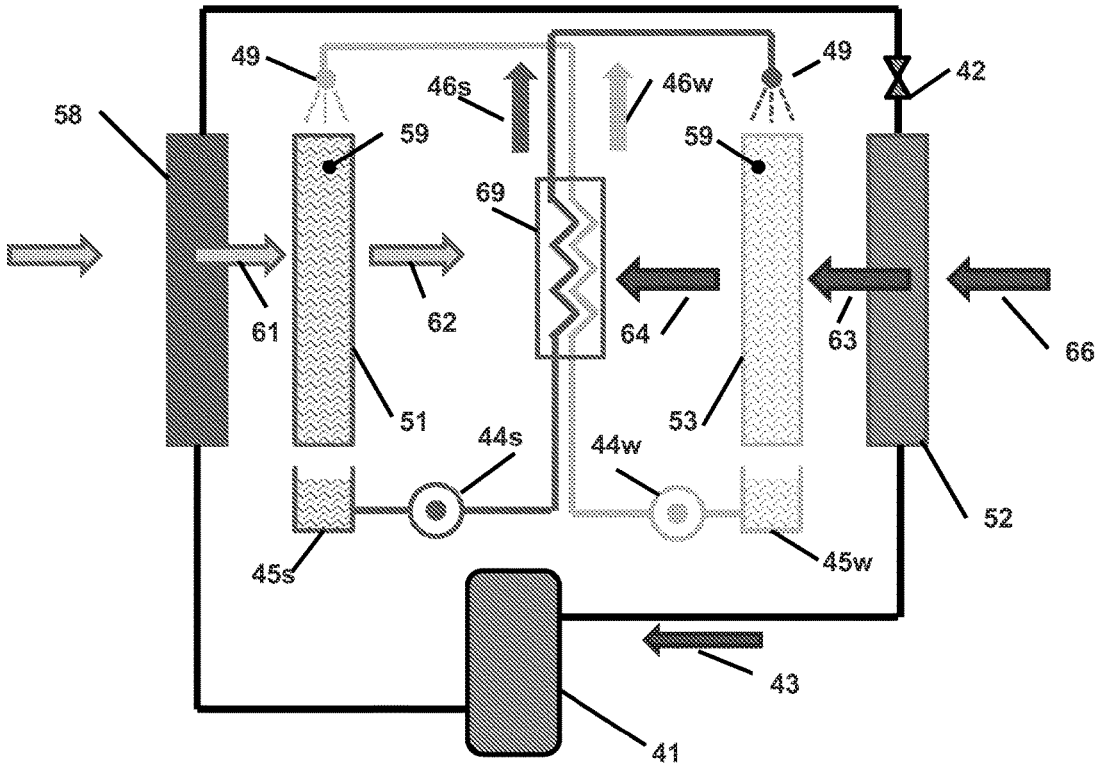
Figure 4 – A Vapor-Compression Air Conditioner with Adiabatic Liquid-Desiccant Absorber and Desorber with Interchange Heat Exchanger (IHX)

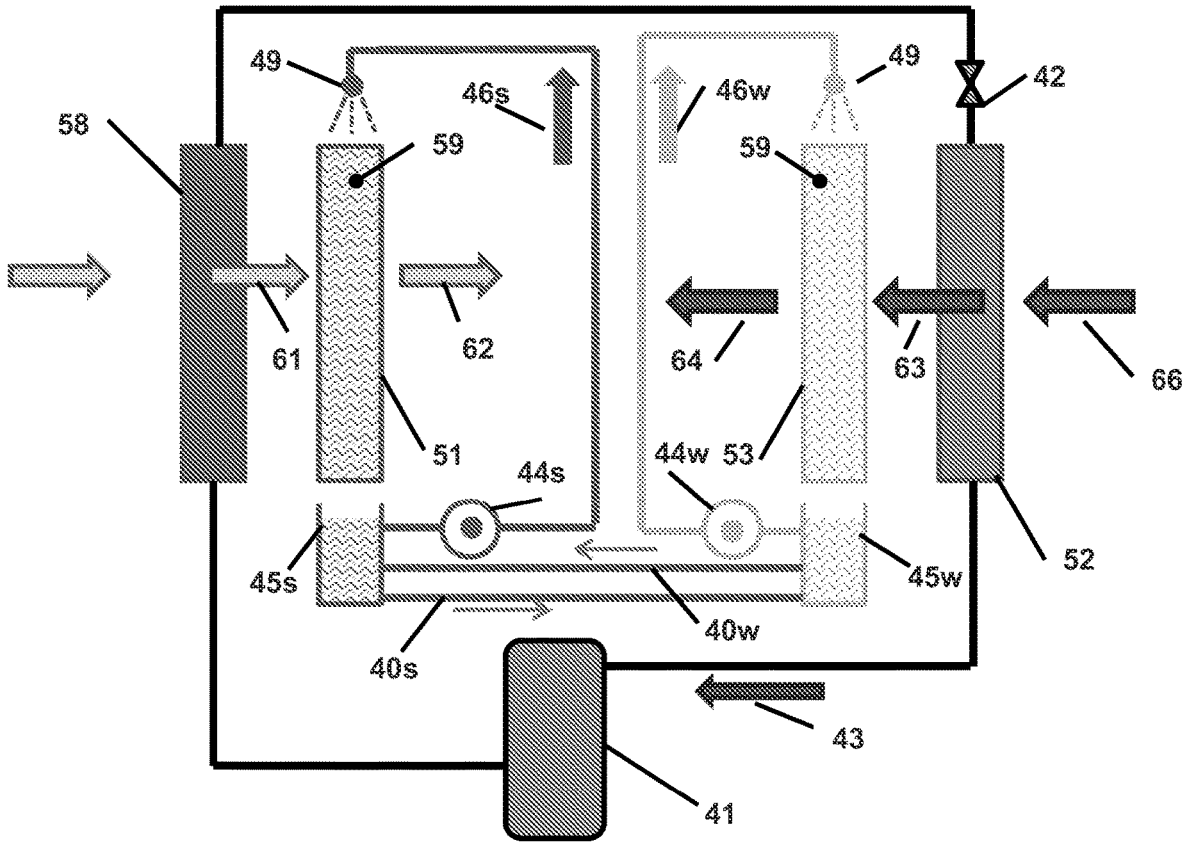
Figure 5 – – A Vapor-Compression Air Conditioner with Adiabatic Liquid-Desiccant Absorber and Desorber with Passive Exchange of Liquid Desiccant between the Absorber Sump and Desorber Sump

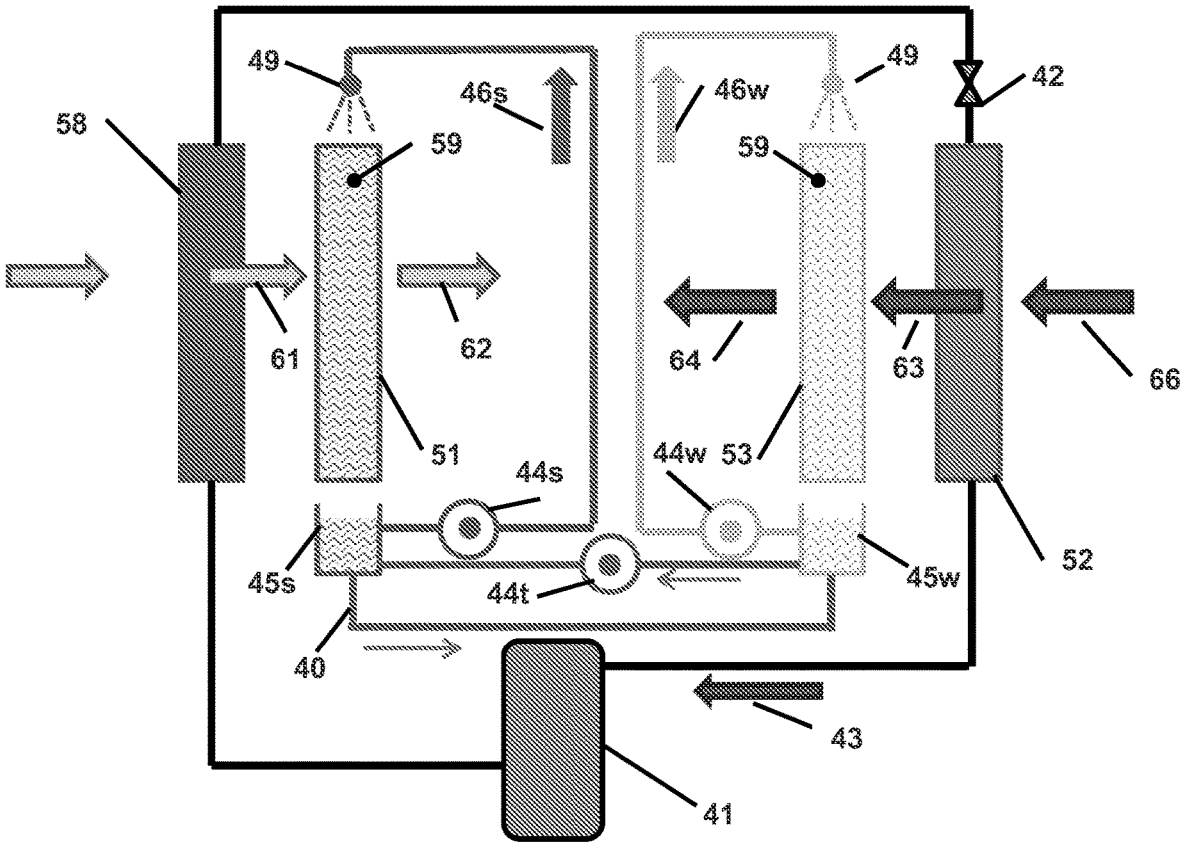
Figure 6 – – A Vapor-Compression Air Conditioner with Adiabatic Liquid-Desiccant Absorber and Desorber with Pumped Exchange of Liquid Desiccant between the Absorber Sump and Desorber Sump

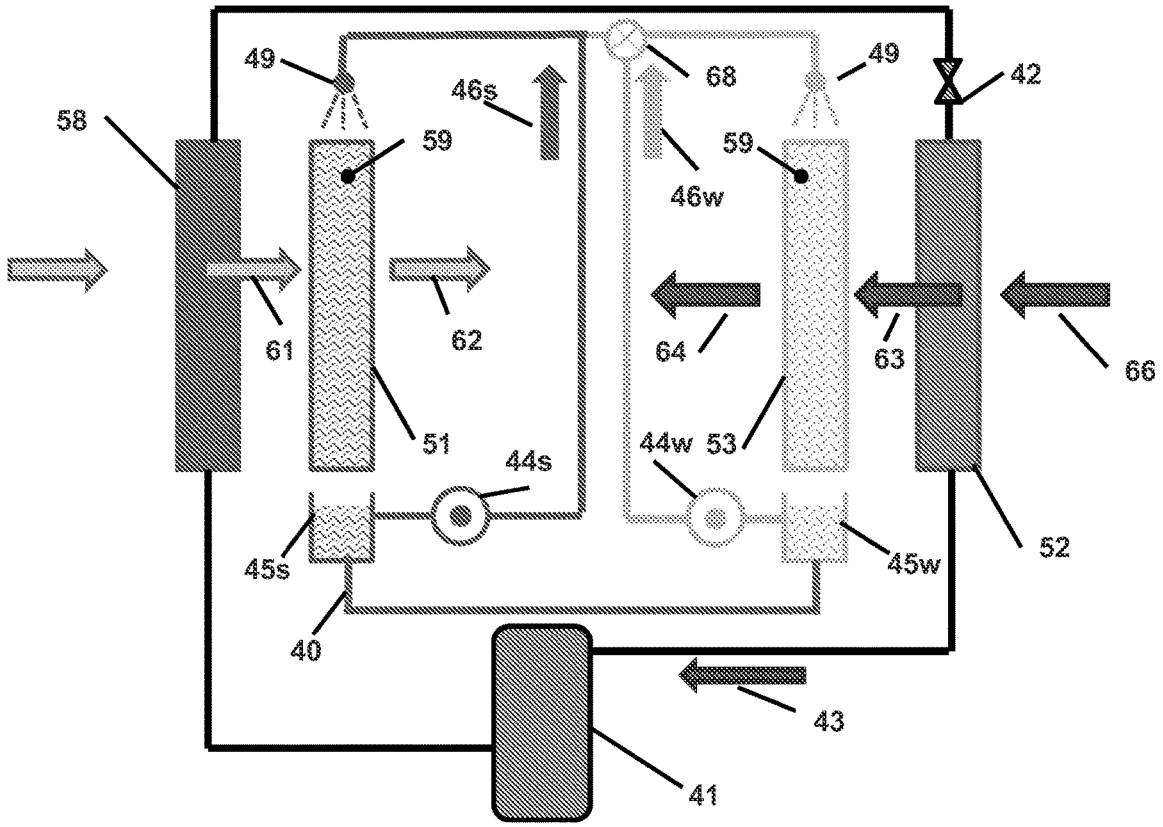
Figure 7 – A Vapor-Compression Air Conditioner with Adiabatic Liquid-Desiccant Absorber and Desorber and the Exchange of Desiccant between Sumps Implemented with a Splitter Valve

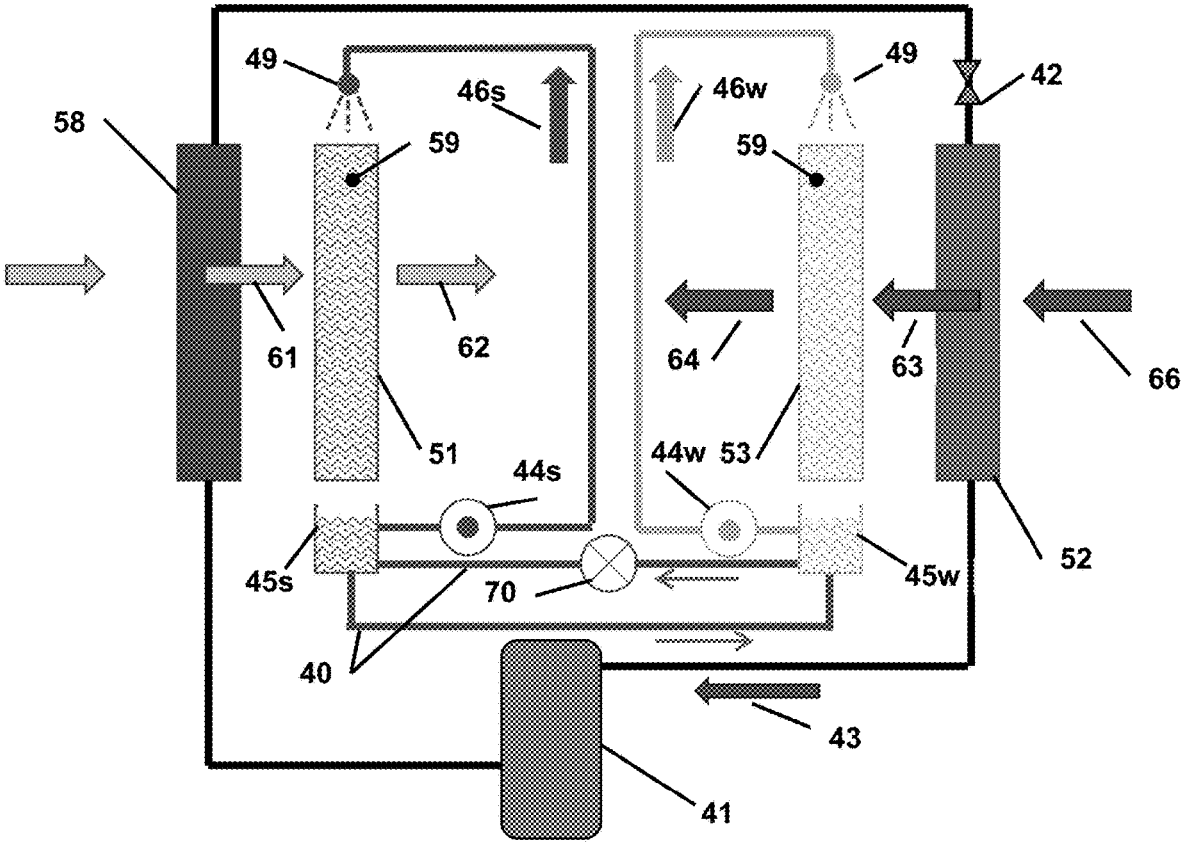
Figure 8 – A Vapor-Compression Air Conditioner with Adiabatic Liquid-Desiccant Absorber and Desorber with the Exchange of Liquid Desiccant between the Absorber Sump and Desorber Sump Controlled by a Modulating Flow Valve.

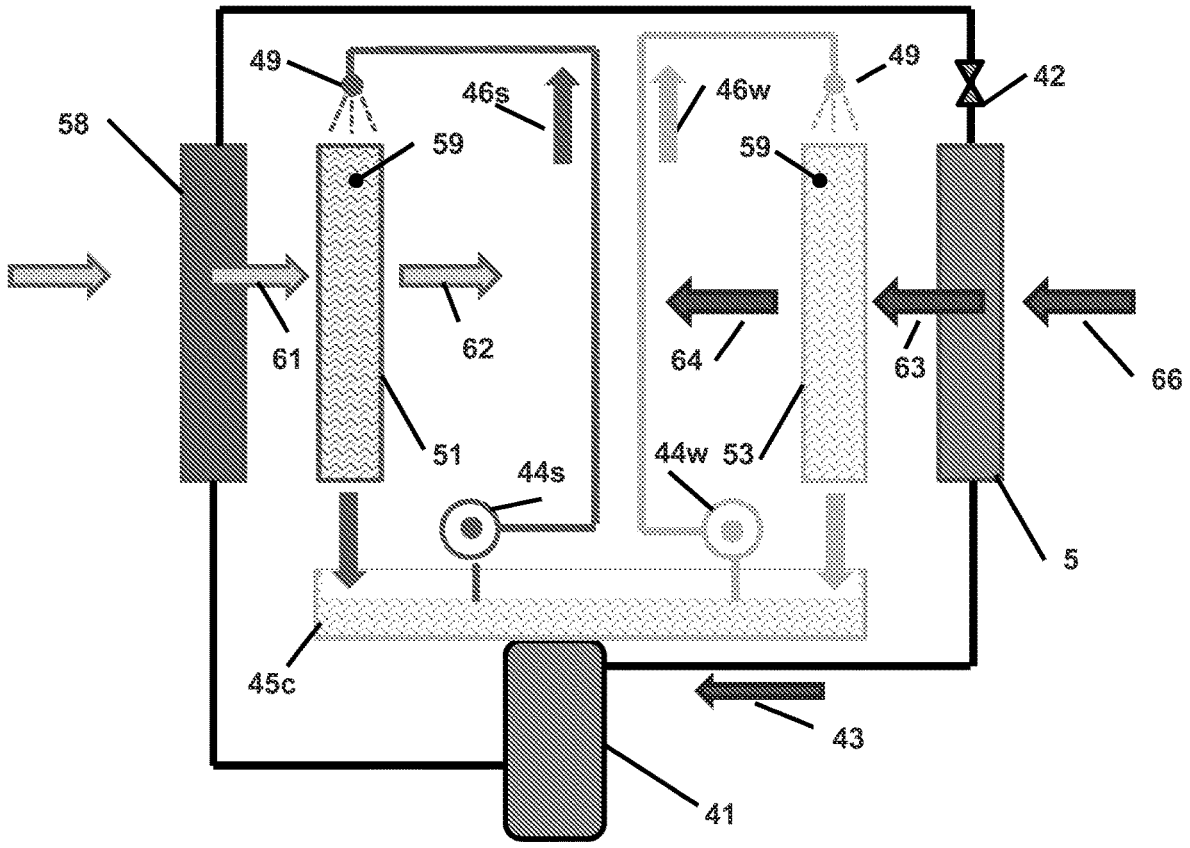
Figure 9 – – A Vapor-Compression Air Conditioner with Adiabatic Liquid-Desiccant Absorber and Desorber and a Common Sump for the Absorber and Desorber

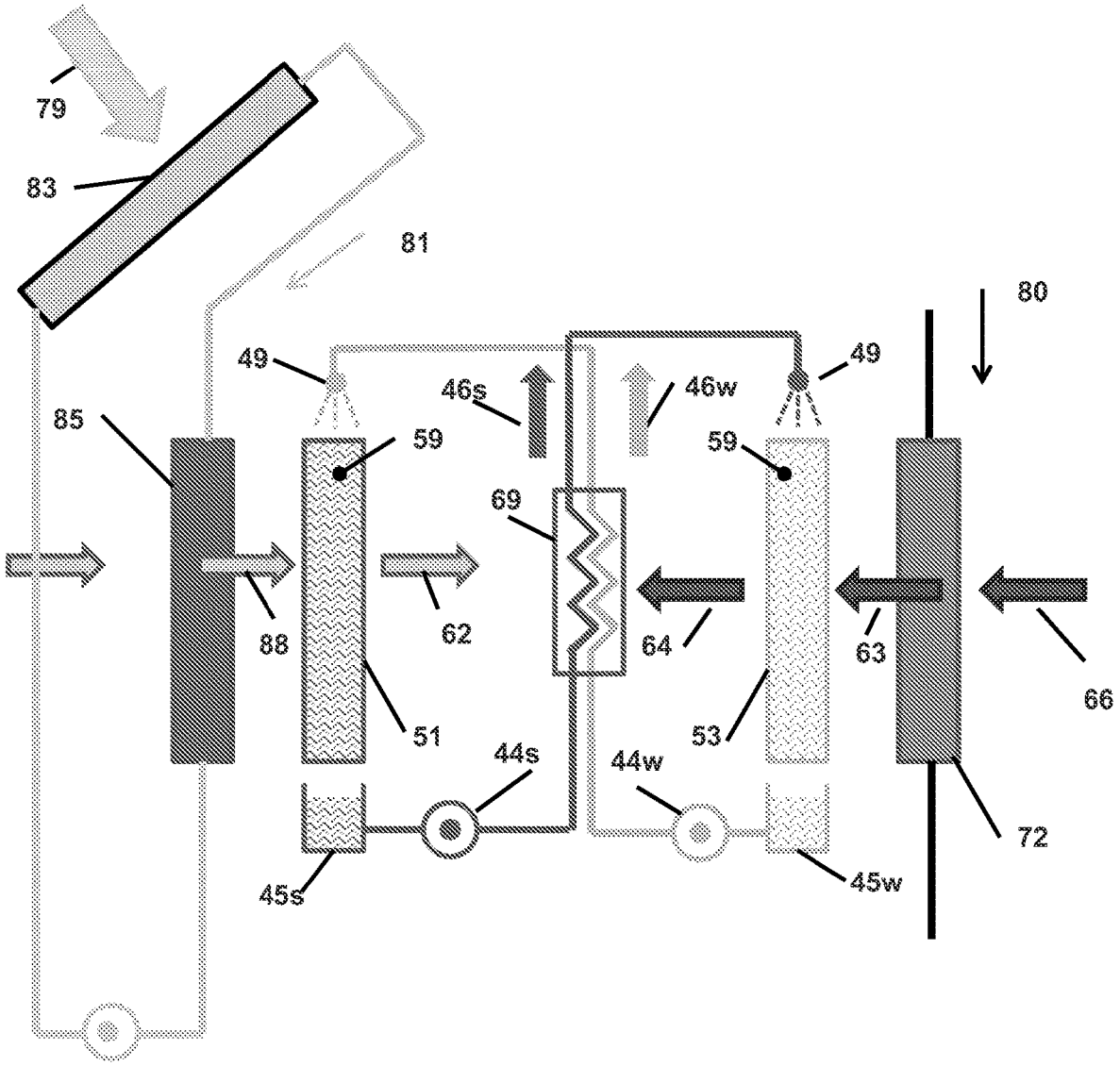
Figure 10 –An Adiabatic Liquid-Desiccant Absorber that Receives Strong Liquid Desiccant from a Solar Regenerator and that Increases the Latent Cooling provided by an Air Heat Exchanger

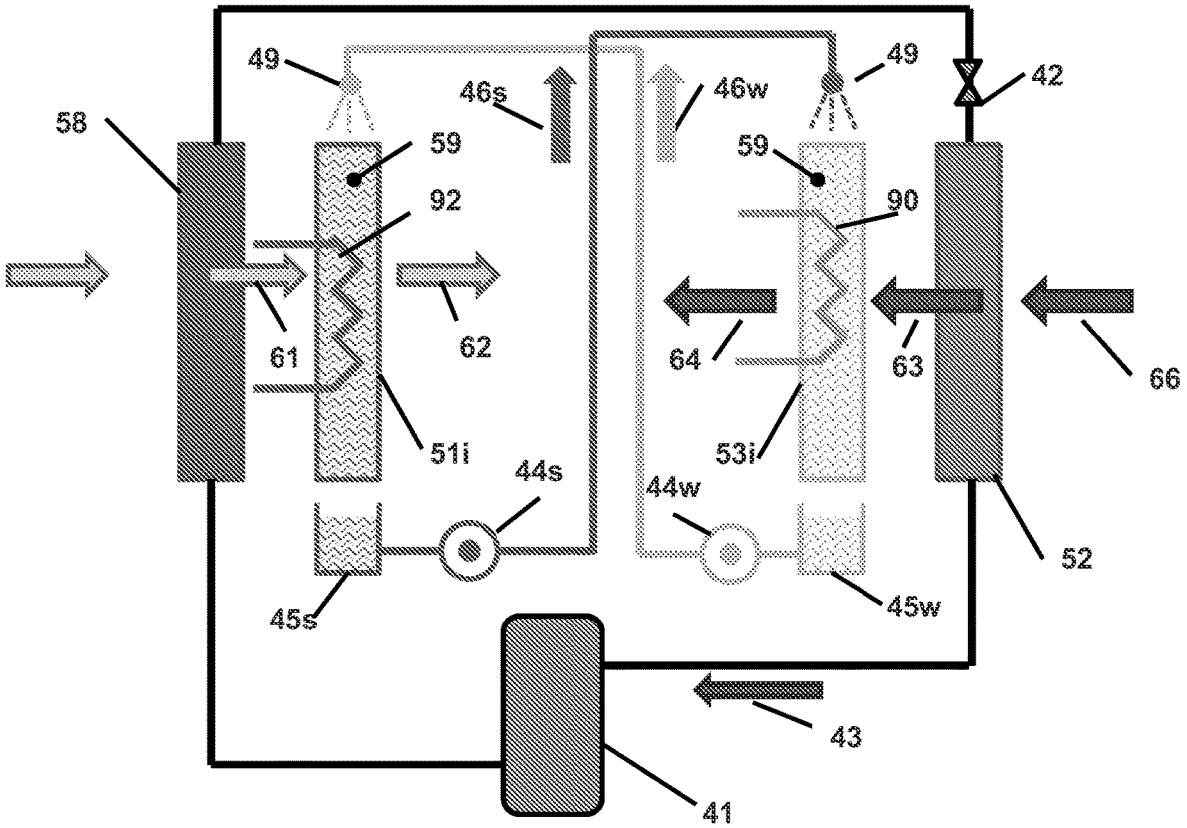
Figure 11 – A Vapor-Compression Air Conditioner with Liquid-Desiccant Absorber and Desorber that have Internal Heat Exchange

METHODS FOR ENHANCING THE DEHUMIDIFICATION OF HEAT PUMPS

GOVERNMENT INTEREST

This invention was made with Government support under Grant No. SBIR FA8501-14-P-0005 awarded by the Department of Defense. The Government has certain rights in this invention.

RELATED APPLICATION

This application is a non-provisional based on U.S. Provisional Patent Application 61/895,809, entitled LIQUID-DESICCANT DIRECT-EXPANSION AIR CONDITIONER, filed Oct. 25, 2013, and U.S. Provisional Patent Application 62/015,155, entitled LIQUID-DESICCANT VAPOR-COMPRESSION AIR CONDITIONER, filed Jun. 20, 2014, the contents of which are incorporated herein in their entirety.

BACKGROUND

Heat pumps are thermodynamic devices that can move thermal energy from a first temperature source to a second, higher temperature sink. This transfer of thermal energy in a direction opposite to the direction it passively flows (i.e., it passively flows from a higher temperature to a lower temperature) requires the expenditure of energy which can be supplied to the heat pump in various forms including electricity, chemical energy, mechanical work or high grade thermal energy.

During warm weather heat pumps are commonly used to move thermal energy from within a building to ambient, i.e., they provide comfort air conditioning to the occupied spaces within buildings. This air conditioning has two important components: sensible cooling, which reduces the temperature within the building, and latent cooling, which reduces the humidity. Comfortable and healthy indoor conditions are maintained only when both the indoor temperature and humidity are controlled, and so a heat pump's sensible and latent cooling are both important.

Unfortunately, heat pumps are not efficient latent cooling devices. Since they "pump" thermal energy and no moisture, they dehumidify only when the process air is cooled below its initial dewpoint temperature. In many applications, the process air that is cooled to a low temperature so that water vapor condenses must be reheated so that a comfortable indoor temperature is maintained. This process of overcooling and reheating wastes energy and increases the cost to maintain comfortable indoor conditions.

Desiccant air conditioners can be a more efficient means for controlling indoor humidity. Desiccants are materials with a high affinity for water vapor. They can be used to directly absorb water vapor from air without first cooling the air below its dewpoint temperature. After the desiccant absorbs water vapor it is heated so that the absorbed water vapor is released to an appropriate sink (e.g., the outdoor ambient). This release of water vapor regenerates the desiccant to a state where it can then again absorb water vapor.

In one type of desiccant air conditioner, the thermal energy for regenerating the desiccant is supplied by the refrigerant condenser of a vapor-compression heat pump. The following five patents and patent applications describe different ways to implement a liquid-desiccant air conditioner that regenerates the desiccant with thermal energy recovered from a refrigerant condenser:

Peterson, et al., U.S. Pat. No. 4,941,324

The Peterson patent describes a vapor-compression air conditioner in which the external surfaces of both the evaporator and condenser of the air conditioner are wetted with a liquid desiccant. Both water vapor and heat are absorbed from the process air that flows over the desiccant-wetted surfaces of the evaporator. The desiccant rejects water to a stream of cooling air that flows over the desiccant-wetted surfaces of the condenser. Under steady operating conditions, the concentration of the desiccant naturally seeks a value at which the rate water is absorbed by the desiccant on the evaporator equals the rate water is desorbed by the desiccant on the condenser.

Forkosh, et al., U.S. Pat. No. 6,546,746; Griffiths, U.S. Pat. No. 4,259,849

Both the Forkosh patent and Griffiths patent describe a vapor-compression air conditioner in which a liquid desiccant is cooled in a refrigerant evaporator and heated in a refrigerant condenser. The cooled desiccant is delivered to and spread over a first bed of porous contact media. Process air that flows through this first porous bed is cooled and dried. The heated desiccant is delivered to and spread over a second bed of porous contact media. Cooling air that flows through this second porous bed gains thermal energy and water vapor from the warm liquid desiccant. As with the Petersen patent, under steady operating conditions the concentration of the desiccant naturally seeks a value at which the rate water is absorbed by the desiccant on the evaporator side of the heat pump equals the rate water is desorbed by the desiccant on the condenser side.

Vandermeulen, et al., U.S. Patent Application US 2012/0125020

The Vandermeulen patent application describes a vapor-compression air conditioner in which a first heat transfer fluid is cooled in a refrigerant evaporator and a second heat transfer fluid is heated in a refrigerant condenser. The cooled first heat transfer fluid cools a first set of membrane-covered plates that have a liquid desiccant flowing on the surface of each plate under the membrane. Process air is cooled and dried as it flows in the gaps between the first set of plates in contact with the membranes. The heated second heat transfer fluid heats a second set of membrane-covered plates that have a liquid desiccant flowing on the surface of each plate under the membrane. The cooling air gains thermal energy and water vapor from the desiccant as it flows in the gaps between the second set of plates in contact with the membranes. As with the Petersen patent, under steady operating conditions the concentration of the desiccant naturally seeks a value at which the rate water is absorbed by the desiccant on the evaporator side of the heat pump equals the rate water is desorbed by the desiccant on the condenser side.

Dinnage, et al., U.S. Pat. No. 7,047,751

The Dinnage patent describes a vapor-compression air conditioner in which the cool, saturated process air that leaves the refrigerant evaporator of the air conditioner flows through the first of two sectors of a desiccant wheel, and the warm, unsaturated cooling air that leaves the refrigerant condenser of the air conditioner flows through the second sector. Water vapor is absorbed from the process air by the desiccant in the first sector and desorbed to the cooling air by the desiccant in the second sector. The desiccant wheel rotates between the two air streams so that absorption and desorption processes occur simultaneously and continuously.

A fifth patent by Lowenstein, et al., (U.S. Pat. No. 7,269,966) describes a technology to implement a liquid-desiccant air conditioner functionally similar to that described in the Peterson patent when the liquid desiccant is a corrosive halide salt solution.

Heat pumps that augment their latent cooling using technology described in the either the Griffiths, Forkosh, Vandermeulen or Dinnage patents will all have fundamental performance limitations. Because the Griffiths and Forkosh patents use beds of porous contact media that are adiabatic (i.e., there is no embedded, internal source of cooling or heating within the beds) desiccant flooding rates must be high compared to the flow of air through the beds. These high flooding rates are required so that the desiccant's temperature neither increases significantly (in the bed where heat is released as the desiccant absorbs water) nor decreases significantly (in the bed where heat is absorbed as the desiccant desorbs water). These high flooding rates require large pumps with high power draws. They also produce large air-side pressure drops in the flooded beds that increase the heat pump's fan power.

A heat pump that uses the Vandermeulen technology must pump a cooling heat transfer fluid between its thermal sink (e.g., a refrigerant evaporator for a heat pump that uses vapor-compression technology) and the liquid-desiccant absorber and it must pump a heating heat transfer fluid between its thermal source (e.g., a refrigerant condenser for a heat pump that uses vapor-compression technology) and the liquid-desiccant desorber. These two heat transfer loops both increase the heat pump's power use and degrade performance by introducing temperature drops that force the heat pump's thermal sink to run at a lower temperature and its thermal source to run at a higher temperature.

The source of the limitations inherent in a heat pump that uses the Dinnage technology is the solid desiccant rotor. In particular:

(a) There is no simple way to pre-cool the warm regeneration (i.e., water desorption) sector of the desiccant wheel as it rotates into the air stream that is to be dehumidified. The heat stored in the mass of the wheel is therefore transferred to this air stream, thereby reducing the cooling effect provided by the air conditioner. Similarly, a significant fraction of the thermal energy in the warm air that regenerates the solid desiccant performs the task of heating the mass of the wheel as the cool process (i.e. water absorption) sector of the solid desiccant wheel rotates into the warm air stream. This heating task reduces the quantity of thermal energy in the warm air that actively desorbs water from the desiccant.

(b) The regeneration sector and process sector of the desiccant wheel must be next to each other. This geometrical constraint requires that the supply air and the regeneration air flow counter to each other in very close proximity.

(c) The circular shapes of the regeneration sector and process sector differ from the rectangular shape that is common for the finned-tube heat exchangers that serve as the air conditioner's refrigerant evaporator and refrigerant condenser. Whereas design constraints on either the height or width of an air conditioner can be accommodated by adjusting the aspect ratio of a rectangular heat exchanger, the desiccant wheel must grow (or shrink) by the same proportion in both its height and width.

A heat pump that applies the technology in the Lowenstein patent also has important limitations, although the limitations are not fundamental, rather centering on the practical concerns of the investment in capital equipment required to manufacture a new heat pump design. In particular, when implemented as a vapor-compression air conditioner the technology in the Lowenstein patent would require a manufacturer to use radically different assembly procedures for the air conditioner's evaporator and condenser then are now used for conventional finned-tube heat exchangers.

SUMMARY OF INVENTION

According to an exemplary embodiment of the present invention, a device for cooling and dehumidifying a first stream of air comprises: a first heat exchanger that cools the first stream of air from a first temperature to a lower second temperature; an absorber comprising: a porous bed of contact media the surface of which is wetted by a first flow of liquid desiccant that is supplied to the absorber and through which flows the first stream of air after it has been cooled in the first heat exchanger, and a first collection reservoir that receives the liquid desiccant that flows off the porous bed of contact media; a regenerator that receives at least a portion of the liquid desiccant that flows into the first collection reservoir and removes water from the received liquid desiccant; and one or more pumps and conduits that perform at least one of the following: exchange liquid desiccant between the absorber and the regenerator, recirculate liquid desiccant within the absorber, or recirculate liquid desiccant within the regenerator, and wherein the device operates under conditions where the liquid desiccant removes moisture from the first stream of air in the absorber and the second temperature of the first stream of air that leaves the first heat exchanger is lower than the temperature of the liquid desiccant supplied to the absorber.

In at least one embodiment, the regenerator is a desorber in which a second stream of air that has been heated to a third temperature in a second heat exchanger flows through a bed of porous contact media that is wetted with liquid desiccant that releases moisture to the second stream of air and a second collection reservoir receiving the liquid desiccant that flows off the bed of porous media in the desorber.

In at least one embodiment, the first heat exchanger and the second heat exchanger are a thermal sink and thermal source of a heat pump.

In at least one embodiment, the first heat exchanger is an evaporator and the second heat exchanger is a condenser of a first vapor-compression heat pump.

In at least one embodiment, the liquid desiccant that flows from the absorber to the regenerator and the liquid desiccant that flows from the regenerator to the absorber exchange thermal energy in a heat exchanger.

In at least one embodiment, one or more conduits fluidly connect the first collection reservoir and the second collection reservoir.

In at least one embodiment, the first collection reservoir and the second collection reservoir have at least one wall in common and at least one opening in the at least one wall that permits liquid desiccant to flow between the two reservoirs.

In at least one embodiment, the first collection reservoir and the second collection reservoir are combined into a single, common collection reservoir.

In at least one embodiment, the ratio of the mass flow rate of the first flow of liquid desiccant and the first stream of air is less than 0.147 under a condition in which both mass flows are measured in the same dimensional units and the surface of the contact media wicks the liquid desiccant.

In at least one embodiment, the contact media that wicks the liquid desiccant comprises corrugated sheets of fiberglass.

In at least one embodiment, the device further comprises at least two conduits that fluidly connect the first collection reservoir and the second collection reservoir, wherein a pump assists the flow of desiccant in at least one conduit.

In at least one embodiment, the pump is adapted to be modulated to vary the exchange of desiccant between the first and second collection reservoirs.

In at least one embodiment, a valve divides the flow that leaves one pump into two flows, one of which is delivered to the absorber and/or first collection reservoir, and the other of which is delivered to the desorber and/or the second collection reservoir.

In at least one embodiment, the valve that divides the flow into two flows can be modulated so that relative magnitude of the two flows can be controlled.

In at least one embodiment, the bed of porous contact media in the absorber does not have an embedded, internal source of cooling and the bed of porous contact media in the desorber does not have an embedded, internal source of heating.

In at least one embodiment, the bed of porous contact media in the absorber has an embedded, internal source of cooling, that source of cooling being the evaporator of a second vapor-compression heat pump, and the bed of porous contact media in the desorber has an embedded, internal source of heating, that source of heating being the condenser of a second vapor-compression heat pump.

In at least one embodiment, the first and second vapor-compression heat pumps share a common compressor.

According to an exemplary embodiment of the present invention, a method for cooling and dehumidifying a first stream of air comprises: cooling the first stream of air by a first heat exchanger from a first temperature to a lower second temperature: wetting a surface of an absorber comprising a porous bed of contact media with a first flow of liquid desiccant that is supplied to the absorber; removing moisture from the first stream of air by the liquid desiccant in the absorber, wherein the second temperature of the first stream of air that leaves the first heat exchanger is lower than the temperature of the liquid desiccant supplied to the absorber, receiving by a first collection reservoir the liquid desiccant that flows off the porous bed of contact media; receiving by a regenerator at least a portion of the liquid desiccant that flows into the first collection reservoir so that water is removed from the received liquid desiccant; and at least one of: exchanging liquid desiccant between the absorber and the regenerator, recirculating liquid desiccant within the absorber, or recirculating liquid desiccant within the regenerator.

In at least one embodiment, the regenerator is a desorber, and the method further comprises the steps of: heating a second stream of air to a third temperature in a second heat exchanger, flowing the second stream of air through a bed of porous contact media that is wetted with liquid desiccant so that moisture is released to the second stream of air; and receiving by a second collection reservoir the liquid desiccant that flows off the bed of porous media in the desorber.

In at least one embodiment, the first heat exchanger and the second heat exchanger are a thermal sink and thermal source of a heat pump.

In at least one embodiment, the ratio of the mass flow rate of the first flow of liquid desiccant and the first stream of air is less than 0.147 under a condition in which both mass flows are measured in the same dimensional units and the surface of the contact media wicks the liquid desiccant.

DESCRIPTION OF FIGURES

FIG. 1 is a block diagram of a solid-desiccant vapor-compression air conditioner as described in U.S. Pat. No. 7,047,751;

FIG. 2 is a block diagram of a vapor-compression air conditioner according to an exemplary embodiment of the present invention with adiabatic liquid desiccant absorber and desorber that augment the air conditioner's latent cooling;

FIG. 3 is a psychrometric chart that shows the state points for both the process air and cooling air that flow through an exemplary embodiment of the invention during typical operation;

FIG. 4 is a block diagram of a vapor-compression air conditioner according to another exemplary embodiment of the present invention with adiabatic liquid desiccant absorber and desorber that augment the air conditioner's latent cooling;

FIG. 5 is a block diagram of a vapor-compression air conditioner according to another exemplary embodiment of the present invention with adiabatic liquid desiccant absorber and desorber that augment the air conditioner's latent cooling;

FIG. 6 is a block diagram of a vapor-compression air conditioner according to another exemplary embodiment of the present invention with adiabatic liquid desiccant absorber and desorber that augment the air conditioner's latent cooling;

FIG. 7 is a block diagram of a vapor-compression air conditioner according to another exemplary embodiment of the present invention with adiabatic liquid desiccant absorber and desorber that augment the air conditioner's latent cooling;

FIG. 8 is a block diagram of a vapor-compression air conditioner according to another exemplary embodiment of the present invention with adiabatic liquid desiccant absorber and desorber that augment the air conditioner's latent cooling;

FIG. 9 is a block diagram of a vapor-compression air conditioner according to another exemplary embodiment of the present invention with adiabatic liquid desiccant absorber and desorber that augment the air conditioner's latent cooling;

FIG. 10 is a block diagram of a vapor-compression air conditioner according to another exemplary embodiment of the present invention with adiabatic liquid desiccant absorber and desorber that augment the air conditioner's latent cooling; and FIG. 11 is a block diagram of a vapor-compression air conditioner according to another exemplary embodiment of the present invention with a liquid desiccant absorber and desorber that augment the air conditioner's latent cooling.

DETAILED DESCRIPTION

The invention claimed here and the benefits it provides can be appreciated by comparing its operation to that of the technology described in the Dinnage patent. FIG. 1 is a block diagram of a vapor-compression air conditioner as disclosed in the Dinnage patent. It shows a vapor-compression air conditioner in which a stream of supply air is cooled in a refrigerant evaporator (52) and a stream of regeneration air is heated in a refrigerant condenser (58). The cool, saturated supply air that leaves the refrigerant evaporator (52) is dried as it passes through the process sector (54) of a rotating desiccant wheel (55). The water absorbed by the desiccant is rejected to the regeneration air as the wheel rotates and what was the "process sector" becomes the "regeneration sector" (60) where the desiccant is heated by the regeneration air.

Although illustrated as applied to a vapor-compression air conditioner, the technology described in the Dinnage patent can increase the latent cooling of other types of heat pumps. Its effectiveness relies on a fundamental property of all desiccants: the amount of water absorbed by the desiccant under equilibrium conditions is a function of the relative humidity of its environment. For heat pumps that cool buildings, the air that leaves the lower temperature thermal sink (e.g., the refrigerant evaporator of a vapor-compression air conditioner) has a much higher relative humidity than the air that leaves the higher temperature thermal source (e.g., the refrigerant condenser of the vapor-compression air conditioner). A desiccant that is alternately exposed to these two air streams will move moisture from the stream with higher relative humidity to the stream with lower humidity. The net effect of this moisture transfer will be to augment the latent cooling provided by the heat pump.

In exemplary embodiments, the present invention eliminates the two geometrical limitations for the technology in the Dinnage patent (the second and third of the previously cited limitations) by replacing the process sector of the desiccant wheel with a liquid-desiccant absorber and the regeneration sector with a liquid-desiccant desorber. For the embodiment of the invention shown in FIG. 2, this substitution of liquid-desiccant technology for solid-desiccant technology requires at least two pumps (44*s*, 44*w*) for moving the liquid desiccant (46*s*, 46*w*) between the absorber (53) and desorber (51). Both the absorber and the desorber have internal beds of porous contact media (59) with surfaces that are wetted with liquid desiccant supplied from a liquid desiccant distributor (49). After flowing down through the separate beds of porous contact media (59), the liquid desiccant drains into separate sumps (45*s*, 45*w*) that supply liquid desiccant to the inlet of the pumps (44*s*, 44*w*).

The embodiment of the invention shown in FIG. 2 cools and dehumidifies a process air stream (66) that, in HVAC applications, commonly is drawn from outdoors, indoors or a combination of the two locations. The process air stream (66) is first cooled in the refrigerant evaporator (52). This cooling both decreases the temperature and increases the relative humidity of the process air stream (63) that leaves the refrigerant evaporator (52) so that its relative humidity is typically greater than 90%. The process air stream (63) with high relative humidity flows through the desiccant-wetted bed of porous contact media (59) in the absorber (53). Since the process air (63) has a very high relative humidity, the liquid desiccant absorbs water vapor from the process air (63). This absorption has three effects: (a) the absolute humidity of the process air decreases, (b) the concentration of the liquid desiccant decreases, and (c) the temperature of the process air increases (this last effect caused by the heat released in the absorption process). Thus, compared to the process air (63) that leaves the evaporator (52), the process air (64) leaves the absorber (53) at a lower absolute humidity and higher temperature. The cool, dry air stream (64) can then be released into the building.

The liquid desiccant that is supplied to the top of the absorber (53) is stronger (i.e., more concentrated) than the liquid desiccant that leaves at the bottom of the absorber (53). The weaker liquid desiccant (46*w*) is pumped from the sump (45*w*) under the absorber (53) to the distributor (49) that delivers liquid desiccant to the desorber (51). In the desorber (51), the water absorbed by the liquid desiccant is rejected to the warm, low relative humidity cooling air (61) that leaves the refrigerant condenser (58) and flows through the desiccant-wetted bed of porous contact media (59) in the desorber (51). After gaining water in the desorber (51), the more humid cooling air (62) is discharged to ambient (e.g., rejected back to outdoors). Having rejected water to the cooling air (62), the liquid desiccant leaves the bottom of the desorber (51) stronger than when it entered the desorber. This stronger desiccant (46*s*) is pumped to the distributor (49) that supplies liquid desiccant to the top of the absorber (53).

(In FIG. 2, the air that gains water as it flows through the desorber has been called "cooling air" since it initially cooled the condenser of the vapor-compression heat pump. In discussions of desiccant technology, this air is also referred to as "regeneration air" and "scavenging air". The cooling air (61) may be drawn in from outside the building.)

FIG. 2 shows one embodiment of the invention where the heat pump is a vapor-compression air conditioner. In addition to its evaporator (52) and condenser (58) this air conditioner has a compressor (41) that circulates a refrigerant (43) and an expansion valve (42) that reduces the pressure of the refrigerant (43) from a high pressure close to the discharge pressure of the compressor (41) to a low pressure close to the suction pressure of the compressor. The vapor-compression air conditioner also has fans for moving the cooling air (61) over the condenser and process air (63) over the evaporator. (The fans are not shown in FIG. 2.)

The enhanced latent cooling provided by the invention shown in FIG. 2 can be appreciated by viewing the process on the psychrometric chart in FIG. 3. For the process shown in FIG. 3, ambient air (State Point A) at 86 F (dry-bulb temperature) and 0.01889 lb/lb (absolute humidity ratio) is both processed in the heat pump's evaporator and used for cooling in the heat pump's condenser. The volumetric flow rate of the air used for cooling is four times greater than that which is processed.

As shown in FIG. 3, the ambient air (State Point A) to be processed is first cooled in the evaporator towards saturation (State Point B), and then further cooled in the evaporator to State Point C. At State Point C, the process air has a relative humidity close to 100%. The nearly saturated process air then flows through the bed of desiccant-wetted porous contact media in the absorber and is dried to State Point D. As previously explained, heat is released when the desiccant absorbs water and the released heat increases the temperature of the process air. The combined effects of the increase in temperature and decrease in absolute humidity reduce the process air's relative humidity to a final value of 49%.

The ambient air (State Point A) that cools the heat pump's condenser leaves the condenser at State Point E, its temperature having increased from 86 F to 112 F. The relative humidity of the cooling air at State Point E is 35%, which when directed to the desorber is sufficiently low to return the weak liquid desiccant flowing into the desorber to the strong concentration required by the liquid-desiccant absorber.

The embodiment of the invention shown in FIG. 2 of a heat pump that uses a liquid desiccant to augment its latent cooling is thermodynamically equivalent to the solid-desiccant implementation shown in FIG. 1. For both the liquid-desiccant and solid-desiccant implementations, the augmented latent cooling provided by the desiccant component can be turned off either by stopping the rotation of the solid-desiccant rotor or stopping the liquid desiccant pumps.

With the desiccant component inactive, the air conditioner would perform similar to a conventional heat pump air conditioner with slightly degraded performance due to the air-side pressure drops through the inactive desiccant components. The on/off cycling of the desiccant component could be used to modulate the ratio of sensible and latent cooling provided by the air conditioner.

The performance of both solid-desiccant and liquid-desiccant implementations is degraded by the thermal energy that is exchanged between the absorbing side and desorbing side as the desiccant moves between these sides (i.e., the first limitation listed above for the Dinnage patent). The liquid-desiccant implementation of a heat pump with augmented latent cooling has an important advantage over its solid-desiccant counterpart in that its efficiency can be improved by adding a liquid-to-liquid heat exchanger to pre-cool the warm desiccant that flows from the desorber to the absorber while preheating the cool desiccant that flows from the absorber to the desorber. This configuration of a liquid-desiccant heat pump used for air conditioning with a liquid-to-liquid interchange heat exchanger (IHX) is shown in FIG. 4. As shown in this figure, warm, strong desiccant (46*s*) from the desorber (51) exchanges thermal energy with the cool, weak desiccant (46*w*) from the absorber, these two desiccant streams flowing on opposite sides of an interchange heat exchanger (69). This exchange of thermal energy has two important effects. First, it reduces the thermal energy transferred from the liquid desiccant to the process air (63) in absorber (53), which increases the amount of cooling provided by the heat pump. The exchange of thermal energy in the IHX (69) also warms the weak desiccant supplied to the desorber, which increases the water rejection in the desorber.

As shown in FIG. 4, the strong desiccant (46*s*) and weak desiccant (46*w*) flows are co-current through the IHX (69). As is commonly practiced in the design of heat exchangers, the exchange of thermal energy in the IHX could be increased by directing the two flows counter-current through the IHX.

The embodiments of the invention shown in FIGS. 2 and 4 have "once through" desiccant circuits-all the desiccant that leaves the desorber (51) is pumped to the absorber (53) and all the desiccant that leaves the absorber (53) is pumped to the desorber (51). Means for controlling the relative amount of latent and sensible cooling can be incorporated into the invention by modifying the desiccant circuit so that the flow rates of desiccant to the absorber and desorber are independently controlled.

FIG. 5 shows an embodiment of the invention in which the flow rates of desiccant to the absorber and desorber can be independently controlled. In this embodiment, strong desiccant (46*s*) from the sump (45*s*) under the desorber (51) is pumped to the top of the desorber (51) and weak desiccant (46*w*) from the sump (45*w*) under the absorber (53) is pumped to the top of the absorber (53). Since the pumped desiccant circuits no longer provide the fluid communication between the desorber and absorber necessary to transfer water in the desiccant from the absorber to desorber, an alternate means of fluid communication must be provided.

In the embodiment shown in FIG. 5, the alternate means of fluid communication is a pair of transfer tubes (40*s*, 40*w*) that connect the sump of the absorber (45*w*) with the sump of the desorber (45*s*) at two different elevations within the sumps. The height and density of the desiccant within each sump determines the vertical distribution of hydrostatic pressure within the sump. When the height of desiccant in the two sumps is the same, the hydrostatic pressure in the sump with the more dense desiccant (i.e. the strong, more concentrated desiccant) will always be higher than that in the other sump at the same elevation in the sumps (assuming that both sumps sit on the same horizontal plane). Furthermore, this difference in hydrostatic pressure will be larger at lower elevations within the sumps.

During the operation of the embodiment shown in FIG. 5 the absorption of water by the desiccant in the absorber will raise the level of desiccant in the absorber sump (45*w*). Similarly, the desorption of water by the desiccant in the desorber will lower the level of desiccant in the desorber sump (45*s*). A steady-state operating condition will be reached when the height and concentration of desiccant in the two sumps establish a flow of weak desiccant from the sump under the absorber (45*w*) through the upper transfer line (40*w*) to the sump under the desorber (45*s*) and a flow of strong desiccant from the sump under the desorber (45*s*) through the lower transfer line (40*s*) to the sump under the absorber (45*w*), and these two flows satisfy the conditions that the net flow of water from the absorber to the desorber equals the rate that water is absorbed from the process air and the net flow of the non-water component of the desiccant (e.g., lithium chloride when the liquid desiccant is an aqueous solution of lithium chloride) is zero.

In the embodiment shown in FIG. 5, the means of fluid communication between the desorber and the absorber will affect the difference in concentration between the weaker desiccant (46*w*) that is delivered to the absorber (53) and the stronger desiccant (46*s*) that is delivered to the desorber (51). A means of fluid communication that promotes the exchange of desiccant between the absorber and desorber will decrease the difference in desiccant concentration, and one that inhibits the exchange will increase the difference. Furthermore, the amount of latent cooling (i.e., dehumidification) provided by the absorber will decrease as the difference in desiccant concentration increases since this increase in the difference in desiccant concentration reflects a weaker desiccant delivered to the absorber and a stronger desiccant delivered to the desorber. By providing a means of fluid communication between the desorber and absorber that can control the exchange of desiccant, the fraction of total cooling provided by the heat pump that is latent can be actively adjusted to meet a building's need for latent and sensible cooling.

When the means of fluid communication is two transfer tubes, as shown in FIG. 5, the diameter, length and the elevation of the location where the transfer tubes (40*s*, 40*w*) connect to the sumps will affect the rates that strong and weak desiccant are exchanged between the two sumps (45*s*, 45*w*). In general, longer and smaller diameter tubes will restrict the exchange of desiccant and produce larger differences in the desiccant concentration between the two sumps. Reducing the difference in elevation of the locations where the two transfer tubes connect to the sumps will also tend to restrict the exchange of desiccant.

Although it would be very restrictive to the exchange of desiccant, it is feasible to replace the two transfer tubes (40*s*, 40*w*) shown in FIG. 5 with a single transfer tube. In this embodiment, the two exchanged flows of weak and strong desiccant will both be in the one transfer tube, the weak desiccant flowing one way in the upper half of the tube and the strong desiccant flowing in the opposite direction in the lower half. The length of this single transfer tube could be shortened to lessen the restriction it imposes. Furthermore, in an embodiment in which the two sumps share a common sidewall, the transfer tube could be replaced with a simple hole in the sidewall.

FIGS. 6, 7 and 8 show different means to control the exchange of weak and strong desiccant between the two sumps of the invention. In the embodiment of the invention shown FIG. 6, a transfer pump (44*t*) moves weak desiccant from the sump under the absorber (45*w*) to the sump under the desorber (45*s*) and strong desiccant moves in the opposite direction through a transfer tube (40) that connects to the sumps below the locations where the pump inlet and outlet connect.

In the embodiment of the invention shown in FIG. 7, a splitter valve (68) located downstream of the pump (44*w*) for the weak desiccant diverts a portion of the weak desiccant (46*w*) to the desorber (51). Strong desiccant returns to the sump (45*w*) under the absorber (53) through the transfer tube (40). For embodiments in which the splitter valve can be controlled, the exchange of weak and strong desiccant between the two sumps can be modulated. The benefits of the splitter valve (68) can be captured in configurations in which the splitter valve is downstream of the pump (44*s*) for the strong desiccant and configurations in which the splitter valve directs a portion of the desiccant flow to either the strong or weak desiccant sump rather than the corresponding desiccant distributor.

In the embodiment of the invention shown in FIG. 8, the exchange of weak and strong desiccant between the sump (45*w*) under the absorber and the sump (45*s*) under the desorber is induced by differences in hydrostatic pressure, similar to the exchange in the embodiment shown in FIG. 5. However, the exchange in the embodiment shown in FIG. 8 is controlled by a modulating flow valve (70) that can vary the resistance in the transfer line (40).

The embodiments of the invention shown in FIGS. 6, 7 and 8, by controlling the exchange of weak and strong desiccant between the two sumps, provide a means for varying the concentration of the desiccant delivered to the absorber and the desorber. As previously noted, this control of desiccant concentration and be used to control the fraction of total cooling provided by the heat pump that is latent cooling.

FIG. 5 illustrates an embodiment of the invention in which the transfer tubes are the only means of fluid communication between the absorber and desorber. The alternate means of fluid communication between the absorber and desorber that are shown in FIGS. 5, 6 and 8 could also be applied to the embodiments of the invention shown in FIGS. 2 and 4 where the desiccant pumps (44*s*, 44*w*) already provide fluid communication between the absorber and desorber. When the alternate means of fluid communication is applied, the pump for the weak desiccant (44*w*) and the pump for the strong desiccant (44*s*) can be independently controlled. The "once through" requirement that all the desiccant draining into the sump under the absorber (45*w*) be pumped to the desorber and all the desiccant draining into the sump under the desorber (45*s*) be pumped to the absorber no longer applies.

The commercial value of the invention will depend both on its performance and its capital cost. Embodiments of the invention that simplify its design, thereby reducing its manufacturing costs, can produce a more commercially viable product if the associated degradation in performance is not too great.

The embodiment of the invention shown in FIG. 9 is a simplification in which the desiccant leaving the absorber (53) and the desiccant leaving the desorber (51) flow into a common sump (45*c*). This embodiment avoids the costs of separate sumps and the means of exchanging desiccant between the two sumps. However, with a single sump (45*c*) the concentration of the desiccant delivered to the absorber (46*w*) and to the desorber (46*s*) will be the same and so this simplified embodiment does not provide control of the latent cooling supplied by the heat pump. Also, since the desiccant delivered to the absorber and the desorber comes from a common sump, the enhancement in performance provided by the interchange heat exchanger (69) shown in FIG. 4 cannot be captured.

As previously explained, an interchange heat exchanger (69) improves the performance of a heat pump that uses a liquid-desiccant absorber and desorber to augment its latent cooling through two effects: (a) it reduces the thermal energy transferred from the liquid desiccant to the process air (63) in absorber (53), and (b) it warms the weak desiccant supplied to the desorber, which increases the water rejection in the desorber. In embodiments of the invention that do not use an interchange heat exchanger, it will be important to minimize the flows of liquid desiccant to both the absorber and the desorber so that the deleterious thermal energy exchanges that accompany these flows are minimized.

Both the liquid-desiccant absorber (53) and desorber (51) used in the embodiments of the invention shown in FIGS. 2 through 9 are adiabatic, i.e., they do not have an internal source of heating or cooling within their beds of porous contact media (59). Although the liquid-desiccant absorbers and desorbers that are part of the inventions in the U.S. Pat. Nos. 4,259,849 and 6,546,746 do not have internal heat exchange, the conditions under which they operate require that they be supplied relatively high flows of liquid desiccant. In particular, the absorbers in both patents are designed to cool and dry a stream of air that initially is warm and humid. To perform this function, the liquid desiccant that is supplied to absorber must be cooled to a temperature that is lower than the final temperature of the air that is being processed. Furthermore, as already explained, high flooding rates are required so that the desiccant's temperature does not significantly increase during the exothermic absorption of water by the liquid desiccant.

In contrast to the operation of the absorbers in both U.S. Pat. Nos. 4,259,849 and 6,546,746, the absorber in embodiments of the invention processes air that initially is humid, but cool (e.g., air that has been cooled by the evaporator of a vapor-compression air conditioner or other air-cooling heat exchanger). The temperature of the air (63) to be processed will be lower than the temperature of the desiccant (46*w*) that is supplied to the absorber. Heat is again released as the liquid desiccant absorbs moisture from the process air, but the low temperature process air now cools the liquid desiccant and limits its temperature rise. Under the operating conditions of embodiments of the invention, there is no need to flow desiccant at a high rate as a means to limit the rise in the desiccant's temperature.

As an example, the present invention can have an absorber that operates with a horizontal air flow and vertical desiccant flow, and has the following characteristics:

Porous Contact Media: corrugated sheets of fiberglass

Volumetric Surface Area of Media: 420 $m^2/m^3$ (based on wetted surface area)

Media Dimensions: 1.0×0.1×1.0 m (width×depth×height)

Desiccant Flooding Rate: 25 l/min-$m^2$ (based on top, horizontal surface of the media)

Air Face Velocity: 1.3 m/s

With these characteristics the total air flow and desiccant flow through the porous media is 1.3 $m^3/s$ and the 2.5 l/min, respectively. At typical values for density for air (1.2 $kg/m^3$) and desiccant (1.25 kg/l), the mass ratio of liquid desiccant to gaseous air (L/G) is 0.033. If the process air entering the absorber is 54° F. and 99% rh (0.008788 lb/lb absolute humidity), and liquid desiccant supplied to the absorber is 27.5% lithium chloride at 85.6° F., the process air leaving the absorber will be 65.9° F. and 57.5% rh (0.007764 lb/lb absolute humidity).

It will be advantageous to operate the absorber of embodiments of the invention at low flow rates of liquid desiccant because (1) low flow rates reduce the size and power of the pumps required to circulate the liquid desiccant, (2) fan power required to move the air through the absorber will be less when desiccant flow rates are low, (3) it is less likely that droplets of liquid desiccant will be entrained by the air when liquid flow rates are low, and (4) the previously described penalty that accompanies the thermal energy in the flow of liquid desiccant will be less.

Griffiths describes the porous contact media for the absorber in U.S. Pat. No. 4,259,849 as composed of "corrugated sheet material impregnated with a thermosetting resin." The porous contact media most commonly used in the absorbers of commercially available liquid-desiccant systems that use halide salt solutions is a cellulosic corrugated media similar to that manufactured and sold as CELdek © by the Munters Corporation, of Aachen, Germany.

The engineering application manual for CELdek © specifies that "to get sufficient wetting and optimal performance" when operating with water, the flooding rate for a CELdek © pad 5090-15 (which has approximately the same volumetric surface area as the corrugated media in the previous example of the invention) should be no lower than 90 l/min per square meter of top, horizontal surface area. Furthermore, the highest face velocity for air flowing horizontally that does not lead to liquid droplet entrainment from a CELdek © 5090-15 pad is 3.0 m/s. Thus, at the lowest flooding rate and highest air velocity, a conventional CELdek © 5090-15 pad will have a mass ratio of liquid to gas (L/G) equal to 0.042.

It is important to note that the preceding minimum flooding rate for CELdek ©—90 l/min-m$^2$—is required to get good coverage of the media's surfaces by water. When CELdek © and cellulosic corrugated media similar to CELdek © are used with liquid desiccants such as solutions of lithium chloride, the higher surface tension of the liquid desiccant inhibits wetting of the media. Consequently, higher flooding rates must be used to insure good wetting and coverage of the media when the liquid is a liquid desiccant. Liquid desiccant dehumidifiers manufactured and sold by Kathabar will have flooding rates of the cellulosic corrugated media that typically are 240 l/min-m$^2$ (6 gpm/ft$^2$). Since the density of the liquid desiccant typically is 1.3 times that of water, an absorber in a conventional liquid desiccant dehumidifier will operate at a mass ratio of liquid to gas (L/G) closer to 0.147—a value that is more than four times higher than the L/G ratio for an absorber in the previous example of the invention.

To effectively capture the benefits of the invention, the liquid-desiccant absorber used in all embodiments must have good wetting of the porous bed of contact media when liquid desiccant is supplied to the absorber at rates on the order of 25 l/min per square meter of top, horizontal surface area or lower. As previously noted, this rate will be too low to insure good wetting of the surfaces of a cellulosic corrugated media.

Good wetting of the contact media in an absorber has been achieved at liquid-desiccant flow rates of 25 l/min-m$^2$ with a solution of lithium chloride at between 25% and 35% salt concentration when the porous contact media is made from a substrate that wicks the liquid desiccant. An example of a porous contact media that wicks liquid desiccant is the fiberglass corrugated media manufactured and sold by the Munters Corporation under the trade name GLASdek ©.

The advantages derived from operating the absorber at low flow rates of liquid desiccant will also apply to the operation of the desorber. Furthermore, in the embodiments of the invention shown in FIG. 2 through FIG. 9 the properties of the liquid desiccant that is supplied to the absorber will be very similar to those of the liquid desiccant that is supplied to the desorber. Because of this similarity in properties the design and operation of the desorber will be very similar to the design and operation of the absorber. Similar to the absorber, the performance of the desorber will benefit from its operation at a low mass ratio of liquid-to-gas flowing through the desorber and a porous contact media with wicking surfaces so that its surfaces can be uniformly wet by a low flow of liquid desiccant.

FIG. 2 through FIG. 9 all show embodiments of the invention that increase the latent cooling provided by a heat pump. In these embodiments, a liquid-desiccant absorber receives a stream of air that first passes through the heat sink of a heat pump (e.g., the evaporator of a vapor-compression heat pump) and the liquid-desiccant desorber receives a stream of air that first passes through the heat source of a heat pump (e.g., the condenser of a vapor-compression heat pump). Furthermore, the absorber and desorber are fluidly coupled so that a portion of the strong liquid desiccant that leaves the desorber can be delivered to the absorber and a portion of the weak liquid desiccant that leaves the absorber can be delivered to the desorber.

The invention can also increase the latent cooling provided by a heat exchanger that cools air by drying the air that leaves the heat exchanger in an absorber that receives strong liquid desiccant from an external source. FIG. 10 shows an embodiment of the invention in which solar radiation (79) falling on a solar collector (83) produces hot water (81) that is pumped to an air heater (85). The heated air (88) that leaves the air heater (85) is supplied to a liquid-desiccant desorber (51) where the heated air, which has a low relative humidity, gains water from the liquid desiccant. The concentrated liquid desiccant (46*s*) produced in the desorber is pumped to the liquid-desiccant absorber (53). An air-cooling heat exchanger (72) reduces the temperature of a process stream of air (66). The air-cooling heat exchanger (72) shown in FIG. 10 is supplied a coolant (80), which can be an evaporating refrigerant or chilled heat transfer fluid. The air-cooling heat exchanger (72) could also be the heat sink of a heat pump that does not circulate a coolant or refrigerant, such as the heat pumps referred to as (1) thermoelectric devices, (2) Stirling coolers, (3) thermoelastic devices, (4) magnetoacoustic devices, (5) magnetocaloric devices, and (6) thermoacoustic devices. The cooled process stream of air (63) that leaves the air-cooling heat exchanger (72), which now has a high relative humidity, enters the liquid-desiccant absorber (53). The water vapor in the cooled process air is absorbed by the liquid desiccant in the absorber. The dried process air (64) leaves the absorber and is supplied to an end-use that requires cool and dry air. The weak liquid desiccant (46*w*) that leaves the absorber is pumped to the desorber where it is regenerated to a strong concentration.

The essential features of the invention that are embodied in the system shown in FIG. 10 are (1) cooled process air with a high relative humidity is dried in a liquid-desiccant absorber that is supplied liquid desiccant whose temperature is higher than that of the entering process air, and (2) the mass flow of liquid desiccant supplied to the absorber is low compared to the mass flow of process air, the liquid-to-gas (LUG) mass ratio of the two flows being less than 0.147.

In FIG. 10, the liquid desiccant regenerator that produces strong liquid desiccant is a desorber that receives warmed air from a heat exchanger heated by hot water provided by a solar collector. Many other types of regenerators and heat sources for the regenerator could replace the regenerator shown in FIG. 10 without affecting the essential features of the invention shown in this figure. In particular, the regenerator could be a device commonly described as a scavenging-air regenerator or it could be a boiler for liquid desiccants. Also, the source for thermal energy to drive the regenerator could be heat recovered from a cogeneration system or hot water provided by a gas-fired water heater.

The embodiment shown in FIG. 10 uses a previously described "once through" desiccant circuit with an interchange heat exchanger (69) transferring thermal energy between the strong liquid desiccant (46*s*) and the weak liquid desiccant (46*w*). While an interchange heat exchanger will significantly improve performance when the strong liquid desiccant (46*s*) that leaves the desorber (51) is hot (as it may be when the regenerator is driven by high temperature thermal energy), the particular desiccant circuit shown in FIG. 10 could be replaced with the liquid desiccant circuits shown in FIGS. 2, 5, 6, 7, 8 and 9.

The embodiments of the invention shown in FIG. 2 through 10 all use adiabatic absorbers and desorbers. It is recognized that the objective of increasing the latent cooling provided by an air-cooling heat exchanger could be achieved by further processing the cool, high relative humidity air leaving the air-cooling heat exchanger in a liquid-desiccant absorber that was internally cooled. Also, it is recognized that the improvement in the performance of a liquid-desiccant desorber that rejects water to a stream of air that has been preheated by first passing through the heat source of a heat pump would also occur when the desorber was internally heated. FIG. 11 shows an embodiment of the invention similar to the one shown in FIG. 2, but with an internal source of cooling (90) in the liquid-desiccant absorber (53*i*) and an internal source of heating (92) in the liquid-desiccant desorber (51*i*).

The internally cooled absorber (53*i*) and the internally heated desorber (51*i*) shown in FIG. 11 could be the evaporator and condenser, respectively, of a vapor-compression heat pump, both the evaporator and condenser having desiccant-wetted surfaces. Furthermore, the evaporator and condenser with desiccant-wetted surfaces could each be implemented with the technology described in the patent by Lowenstein, et al., (U.S. Pat. No. 7,269,966).

Embodiments of the invention with an internally cooled absorber can supply air with a dewpoint that is close to or below 32° F. without ice or frost accumulating on the absorber since the water vapor that is removed from the process air is absorbed by a liquid desiccant that always has a freezing temperature that is lower than water. Whereas a conventional vapor-compression heat pump that supplied air with a dewpoint close to or below 32° F. would require inefficient defrost cycles in which the evaporator's temperature was increased above 32° F. so that any accumulated ice and frost melted and drained off the evaporator as water, the embodiment of the invention applied to a vapor-compression heat pump with an internally cooled absorber could supply air at the same low dewpoint while operating uninterrupted by defrost cycles.

For embodiments of the invention that derive from the configuration shown in FIG. 11 in which the initial cooling of the process air (66) and heating of the regeneration air (61) occurs in the evaporator and condenser of a vapor-compression heat pump and the internally cooled absorber (53*i*) and the internally heated desorber are also the evaporator and condenser of a vapor-compression heat pump, the refrigeration circuits for the two vapor-compression heat pumps can either be independent of each other or they can share components. For embodiments of the invention with refrigeration circuits that share components, the components that might be shared include the compressor, expansion valve, refrigerant receiver, refrigerant accumulator, refrigerant filter, or some combination of these components.

Many different liquid desiccants can be used in the embodiments of the invention described herein. In applications where the invention provides comfort conditioning to occupied spaces, it will be desirable to use a liquid desiccant whose non-water components have extremely low vapor pressures. As an example solutions of ionic salts such as lithium chloride, calcium chloride, lithium bromide, calcium bromide, potassium acetate, potassium formate, zinc nitrate, ammonium nitrate, potassium nitrate can be used as the liquid desiccant. Also, ionic liquids and some liquid polymers function as liquid desiccants with extremely low vapor pressures of the non-water component of the liquid desiccant. In application of the invention where traces of the liquid desiccant can be tolerated in the air supplied to the end-use, the liquid desiccant could be a glycol.

While particular embodiments of the invention have been illustrated and described, it would be obvious to those skilled in the art that various other changes and modifications may be made without departing from the spirit and scope of the invention. It is therefore intended to cover in the appended claims all such changes and modifications that are within the scope of this invention.

The invention claimed is:

1. A device for cooling and dehumidifying a first stream of air, comprising:

a first heat exchanger that cools the first stream of air from a first temperature to a lower second temperature;

a second heat exchanger that heats a second stream of air;

an absorber comprising:

a first porous bed of contact media the surface of which is wetted by a first vertical flow of liquid desiccant that is supplied to the absorber and through which the first stream of air flows after the first stream of air has been cooled in the first heat exchanger; and a first collection reservoir that receives the liquid desiccant that flows off the first porous bed of contact media;

a desorber comprising:

a second porous bed of contact media the surface of which is wetted by a second flow of liquid desiccant and through which flows the second stream of air after the second stream of air has been heated in the second heat exchanger; and a second collection reservoir that receives the liquid desiccant that flows off the second porous bed of contact media; and one or more pumps that supply liquid desiccant to the absorber and desorber;

wherein:

the liquid desiccant removes moisture from the first stream of air in the absorber and releases moisture to the second stream of air in the desorber;

liquid desiccant is exchanged between the absorber and the desorber;

the first porous bed of contact media in the absorber does not have an embedded, internal source of cooling and the second porous bed of contact media in the desorber does not have an embedded, internal source of heating, a ratio defined by a mass flow rate of the first vertical flow of liquid desiccant divided by a mass flow rate of the first stream of air is less than 0.147 under conditions in which both mass flow rates are measured in the same dimensional units, and the second temperature of the first stream of air that leaves the first heat exchanger is lower than the temperature of the liquid desiccant supplied to the absorber.

2. The device of claim 1, wherein the first heat exchanger and the second heat exchanger respectfully are a thermal sink and thermal source of a heat pump.

3. The device of claim 2, wherein the first heat exchanger is an evaporator and the second heat exchanger is a condenser of a first vapor-compression heat pump.

4. The device of claim 1, wherein the liquid desiccant that flows from the absorber to the desorber and the liquid desiccant that flows from the desorber to the absorber exchange thermal energy in an interchange heat exchanger.

5. The device of claim 1, wherein one or more conduits fluidly connect the first collection reservoir and the second collection reservoir.

6. The device of claim 1, wherein the first collection reservoir and the second collection reservoir have at least one wall in common and at least one opening in the at least one wall that permits liquid desiccant to flow between the two reservoirs.

7. The device of claim 1, wherein the first collection reservoir and the second collection reservoir are combined into a single, common collection reservoir.

8. The device of claim 1, wherein at least one of the first or second porous beds of contact media comprises corrugated sheets of fiberglass.

9. The device of claim 5, further comprising at least two conduits that fluidly connect the first collection reservoir and the second collection reservoir, wherein a pump of the one or more pumps assists the flow of desiccant in at least one conduit.

10. The device of claim 9, wherein the pump is adapted to be modulated to vary the exchange of desiccant between the first and second collection reservoirs.

11. The device of claim 1, wherein the first flow of liquid desiccant supplied to the absorber and the second flow of liquid desiccant supplied to the desorber are independently controlled by at least one valve that controls the flow that leaves the one or more pumps.

12. The device of claim 7, wherein a valve divides the flow that leaves a pump of the one or more pumps into two flows, one of which is delivered to the absorber and the other of which is delivered to the desorber.

13. The device of claim 12, wherein the valve that divides the flow into two flows is controllable so that one or both of the two flows can be turned off.

14. The device of claim 12, wherein the valve that divides the flow into two flows is controllable so that the relative magnitude of the two flows can be modulated.

15. The device of claim 7, wherein the first flow of liquid desiccant supplied to the absorber and the second flow of liquid desiccant supplied to the desorber are independently controlled by a first valve that controls the flow to the absorber that leaves the one or more pumps and a second valve that controls the flow to the desorber that leaves the one or more pumps.

16. A method for cooling and dehumidifying a first stream of air, comprising:

cooling the first stream of air by a first heat exchanger from a first temperature to a lower second temperature;

wetting a surface of an absorber comprising a first porous bed of contact media with a first vertical flow of liquid desiccant that is supplied to the absorber;

removing moisture from the first stream of air by flowing the first air stream through the desiccant-wetted first porous bed of contact media, wherein the second temperature of the first stream of air that leaves the first heat exchanger is lower than the temperature of the liquid desiccant supplied to the absorber;

receiving by a first collection reservoir the liquid desiccant that flows off the first porous bed of contact media; and removing moisture from the first flow of liquid desiccant by exchanging liquid desiccant between the absorber and a desorber, the desorber comprising:

a second porous bed of contact media the surface of which is wetted by a second flow of liquid desiccant and through which flows a second stream of air after it has been heated in a second heat exchanger; and a second collection reservoir that receives the liquid desiccant that flows off the second porous bed of contact media, wherein the first porous bed of contact media in the absorber does not have an embedded, internal source of cooling and the second porous bed of contact media in the desorber does not have an embedded, internal source of heating, a ratio defined by a mass flow rate of the first vertical flow of liquid desiccant divided by a mass flow rate of the first stream of air is less than 0.147 under conditions in which both mass flow rates are measured in the same dimensional units.

17. The method of claim 16, wherein the first heat exchanger and the second heat exchanger respectfully are a thermal sink and thermal source of a heat pump.

18. The method of claim 16, wherein the first collection reservoir and the second collection reservoir are combined into a single, common collection reservoir.

* * * * *